US007350558B2

(12) United States Patent
Grinberg

(10) Patent No.: US 7,350,558 B2
(45) Date of Patent: Apr. 1, 2008

(54) METHOD OF VENTING A SPRAY METAL MOLD

(76) Inventor: Grigoriy Grinberg, 4758 Mount Airy Rd., Sylvania, OH (US) 43560

( * ) Notice: Subject to any disclaimer, the term of this patent is extended or adjusted under 35 U.S.C. 154(b) by 0 days.

(21) Appl. No.: 11/070,909

(22) Filed: Mar. 3, 2005

(65) Prior Publication Data

US 2006/0086474 A1 Apr. 27, 2006

Related U.S. Application Data

(60) Provisional application No. 60/621,363, filed on Oct. 22, 2004.

(51) Int. Cl.
*B22D 23/00* (2006.01)
*B22C 15/23* (2006.01)

(52) U.S. Cl. ..... 164/46; 164/7.2

(58) Field of Classification Search ..... 164/46, 164/271, 7.1–7.2, 160.1, 160.2
See application file for complete search history.

(56) References Cited

U.S. PATENT DOCUMENTS 2,629,907 A * 2/1953 Hugger ..... 164/14
3,077,647 A 2/1963 Kugler
3,631,745 A 1/1972 Walkey et al.
3,816,903 A * 6/1974 Garner ..... 29/527.2
4,165,062 A 8/1979 Mitchell
4,420,441 A * 12/1983 Singer ..... 264/7
4,574,451 A * 3/1986 Smashey et al. ..... 29/423
4,697,631 A * 10/1987 Bungeroth et al. ..... 164/46
4,952,355 A 8/1990 Seward et al.
5,108,668 A * 4/1992 Kallup ..... 264/430
5,189,781 A 3/1993 Weiss et al.
5,228,493 A * 7/1993 Siemers et al. ..... 164/46
5,356,580 A 10/1994 Clark et al.
5,371,937 A * 12/1994 Watson et al. ..... 29/527.3
5,591,485 A 1/1997 Weber et al.
5,632,878 A 5/1997 Kitano
5,817,267 A * 10/1998 Covino et al. ..... 264/219
6,367,765 B1 4/2002 Wieder
6,595,263 B2 7/2003 Grinberg et al.
6,746,225 B1 6/2004 McHugh

* cited by examiner

*Primary Examiner*—Kuang Lin
(74) *Attorney, Agent, or Firm*—MacMillan, Sobanski & Todd, LLC

(57) ABSTRACT

The present invention relates to a novel method of venting a spray metal molding surface. More particularly the invention relates to a method of manufacturing a mold using a thermal spray process to produce a metal surface containing passages in the spray metal to vent fluid or gas from the forming surface. The present invention is primarily intended for mold tools, such as vacuum molds, injection molds or blow molds having vents or a multiplicity of holes in the forming surface to evacuate or supply gas in a mold.

20 Claims, 6 Drawing Sheets

METHOD OF VENTING A SPRAY METAL MOLD

CROSS REFERENCE TO RELATED APPLICATIONS

This application claims the benefit of U.S. Provisional Application No. 60/621,363 by Grigoriy Grinberg, filed Oct. 22, 2004.

BACKGROUND OF THE INVENTION

1. Field of Invention

The present invention relates to a novel method of venting a spray metal molding tool. More particularly the invention relates to a method of manufacturing a mold using a thermal spray process to produce a metal surface containing passages in the spray metal to vent or evacuate gas.

2. Description of Prior Art

The present invention is primarily intended for mold tools, such as a vacuum mold having vents or a multiplicity of holes in the forming surface to evacuate or supply gas in a mold. By way of example, vacuum forming of heat-softened sheets of plastic material is well known. Molds suitable for such vacuum forming are typically porous or have holes in the forming surface. A vacuum is applied behind the forming surface that evacuates air from between the mold surface and a heat-softened plastic sheet whereby bringing the sheet into conformance with the mold surface. Additionally, the forming surface may be grained or texturized to produce the desired surface on the plastic sheet.

The vacuum mold may incorporate cooling lines to cool the forming surface and the formed plastic sheet. The vent holes and cooling lines must be located to avoid interference. Care must be used in drilling the vent holes to avoid puncturing a cooling line. Depending on the construction of the mold, cooling lines can be incorporated in the molds metal surface or attached to the back of the metal surface or placed in the backing support structure. One method of constructing a vacuum mold utilizes a self supporting shell as the forming surface. The so-called shell is thin relative to the forming area. The shell can be made from metal, such as aluminum, nickel or kirksite with integral reinforcing ribs and cooling lines. Holes are then drilled through the mold and the mold is backed with a vacuum chamber.

There are several existing and excepted methods, described hereinafter, of creating a mold tool in part or whole with a venting surface and are comprised of, but not limited to:

(a) a mold produced from a cast shell or a machined metal block and drilled with a plurality of vents. Typically mold vents are holes, channels, valves, porous material inserts or other objects that permit gas to exit or enter the mold.

(b) a mold having a porous forming surface produced from a media filled epoxy as described in U.S. Pat. No. 4,952,355 to Seward et al. (1990);

(c) a mold surface having a porous sintered metal forming surface either machined or formed to the desired mold shape;

(d) a mold produced with a porous electroformed material as described in U.S. Pat. No. 5,632,878 to Kitano (1997);

(e) a mold produced from an electroformed or vapor deposited material and drilled with a plurality of vents.

The existing methods of producing a mold surface with a plurality of vents are undesirable for several reasons including time, cost and surface detail capability. The disadvantages of the cast or the machined block mold in method (a) are the time and cost to drill a multiplicity of small vent holes in the surface. In order to place a small diameter vent hole in a cast or machined mold, a large clearance hole must be drilled from the back side of the mold and connected to the small vent hole drilled in the forming surface. This process is required for each vent hole and may take up to an hour for each vent. In a moderate sized mold, several hundred holes may be required to provide adequate venting. The porous epoxy mold in (b) lacks mold face durability and the ability to replicate small surface features and surface texture. The porous epoxy mold surface is generated by a filler media that must adhere to each other and provide interconnected porosity. The dilemma with the porous epoxy mold is that large media must be used to produce the porosity which reduces the strength of the mold. If smaller media is used, the mold can be stronger but lacks enough interconnected porosity. The porous sintered metal method in (c) is undesirable since the material is difficult to produce in bulk thicknesses, resulting in high material cost and long delivery times. The porous sintered material will further require machining or forming to the desired geometry. Machining and forming clogs or plugs the porosity, generating additional work to reactivate the pores. In many cases the pores cannot be unclogged completely which reduces porosity level thereby effecting venting capability. The method in (d) and (e) provides a venting metal surface to the desired shape, but the electroforming process can take several months to produce a mold surface. Although time is the most noted drawback of electroforming, the mandrel or model requirements add additional cost and time to the electroformed mold. An electroformed model must be conductive and made from a compatible material with the selected electroforming process.

Considering the shortcomings of the present technology, it would be desirable to create a new method of venting a mold at reduced cost and time.

A search of prior art found the following patents, relevant to the present invention:

U.S. Pat. No. 6,746,225 McHugh
U.S. Pat. No. 6,595,263 Grinberg et al.
U.S. Pat. No. 6,367,765 Wieder
U.S. Pat. No. 5,632,878 Kitano
U.S. Pat. No. 5,591,485 Weber et al.
U.S. Pat. No. 5,356,580 Clark et al.
U.S. Pat. No. 5,189,781 Weiss et al.
U.S. Pat. No. 4,952,355 Seward et al.
U.S. Pat. No. 4,165,062 Mitchell
U.S. Pat. No. 3,631,745 Walkey et al.
U.S. Pat. No. 3,077,647 Kugler
U.S. Pat. No. 2,629,907 Hugger

BRIEF SUMMARY OF THE INVENTION

The present invention overcomes the cost and time disadvantages of producing a venting mold surface and provides a novel method of fabricating mold vents using a thermal spray technique. Molds embodying the present invention are comprised of a layer of thermal spray metal providing venting channels through the thermal spray metal layer by inter-connected porosity or small holes or a combination of both. In the following description, the term "model" will mean any article that is used as a target, pattern, mandrel for the deposition of the spray metal layer; the term "spray metal layer" will mean a thermally sprayed metal with less than 5% porosity or a thermally sprayed metal with interconnected porosity up to 35% porosity. The term "pin" will mean any rigid object attached to the model and removed after the spray metal process producing a vent in the spray metal layer.

Several methods of the present invention, described hereinafter, of manufacturing a thermal spray mold tool with a venting surface and are comprised of, but not limited to:

(i) a mold surface having a thermal spray metal layer with a plurality of holes produced during the spray process by means of objects inserted or attached to the model such as pins, wire or brads, and removed at a predetermined time after the spray process;

(ii) a mold surface having a thermal spray metal layer with a plurality of holes produced during the spray process by means of holes or cavities in the model;

(iii) a mold surface having a thermal spray metal layer with a plurality of holes produced during the spray process by means of a hollow object such as a needle, tube or pipe that is permanently encapsulated in the spray metal layer;

(iv) a mold surface having a porous thermal spray metal layer with interconnected porosity;

It should be understood that the venting methods (i), (ii), (iii) and (iv) described above can be used individually or combined to efficiently vent a mold surface. The methods in (i), (ii), and (iii) will preferably be a dense spray metal layer, but the spray metal layer in (i), (ii), and (iii) could be porous as in method (iv) with interconnected porosity to provide the mold with additional venting.

The present invention provides a method of producing venting channels in a spray metal article. It is not the intent of the invention to teach the thermal spray metal process, but rather to demonstrate a novel process of manufacturing a venting spray metal article. Spray metal molds have been used for decades, (Garner, P. J., New die making technique, SPE Journal, 27(5), May 1971) and further explained in U.S. Pat. No. 5,189,781 Weiss et al., U.S. Pat. No. 3,631,745 Walkey et al., and U.S. Pat. No. 2,629,907 Hugger. Those skilled in the art of making tools and molds using thermal spray techniques, use aluminum, nickel, low carbon stainless steel, copper, zinc, pseudo-alloys or other metals or alloys and spray on models such as foam, plastic, vinyl, leather, wood, plaster, metal, wax, epoxy, silicone, or ceramic. In most cases the spray metal article is separated from the model using parting agents. Typically parting agents/adhesion promoters are utilized to promote adhesion of the spray metal to the model while also providing a means to separate the model from the spray metal. Most parting agents are comprised of polyvinyl alcohol or other adhesives which promotes bonding of the spray metal to the model surface. Parting agents and promoters are further explained U.S. Pat. No. 3,077,647 Kugler. Another means of separating a model without using a parting agent is by destroying or dissolving the model by mechanical or chemical processes.

A common method for making a spray metal mold utilizes a two-wire arc device. In such a device, two metallic wires are fed there through and sufficiently electrified so that an electric arc is established between the wires, one acting as an anode and the other acting as a cathode. The arc produced is of sufficient power to input enough heat energy to cause both wires to be melted and become molten. Using an air jet, the moltenized wire is propelled in streams toward a target. In most spray metal mold applications a dense metal layer is required to yield the highest strength and wear resistance. However in the present invention either a dense spray metal layer is utilized or a porous spray metal layer with interconnected porosity is used for the mold surface. The spray metal layer thickness typically ranges from 0.030 inch to 0.5 inch and more preferable from 0.050 to 0.125 inch thick.

In the preferred method, the mold surface is comprised of a spray metal layer containing a plurality of channels produced during the spray metal process. In method (i), the channels are holes through the spray metal layer produced by objects, commonly referred to as pins that are attached or inserted in the model as in FIG. 1. A "pin" is typically an object such as wire, nail, brad, or pin. The pin producing the hole must be somewhat rigid to withstand the pressure of the spray. Typically the pins are metal and round, but other rigid materials such as plastic, wood, or glass of round or various profiles will suffice. Preferably a carbon steel wire from 0.003 to 0.080 inch in diameter is used to produce the holes in the surface and more preferably for textured mold surfaces, carbon steel wire diameter from 0.003 to 0.025 inch is utilized. The wire object can be removed immediately after the spray process, but more preferably the wire object is removed later in the tool construction process.

In method (ii), the channels are produced in the spray metal layer by holes placed in the model as in FIG. 9. In this method, the channels are holes produced in the spray metal layer as a result from the backpressure generated by the holes in the model. The hole in the model creates backpressure from the spray metal process and prevents spray material from being deposited in the area of the hole in the model. The depth of the hole in the model is typically deeper than the desired spray metal layer thickness. Hole size is typically from 0.003 to 0.080 inch in diameter and more preferably from 0.003 to 0.025 inch. In another configuration, the holes in the model can be connected to a gas supply to prevent spray metal buildup in the hole area as in FIG. 10.

In another method of the present invention, method (iii), the channels are holes through the spray metal that are produced by a hollow object attached to the model and permanently encapsulated in the spray as in FIG. 11. Hollow metal objects such as needles or tubes are permanently encapsulated in the spray metal with the inside diameter of the hollow object ranging from 0.003 to 0.080 inch and more preferably from 0.003 to 0.025 inch. For large hollow objects, the inside diameter is filled with foam, wax, or other material that can be removed or dissolved after the spray process to produce the vent.

In method (iv), the channels are produced by interconnected porosity in the spray metal layer. The interconnected porosity typically ranges from 5% to 35%. Porosity levels less than 5% in the spray metal layer typically prevent gas flow or venting in the spray metal layer.

The methods described in the present invention can be used to produce a self supporting metal shell or a thin metal shell requiring a reinforcement backing structure. Once the spray metal surface with vents is sprayed, tool construction with the spray metal layer diverges and takes on many forms as required by the type of molding application. The spray metal layer with a venting surface is suitable for entire mold surfaces or may be used in a local area of a conventional mold as a venting surface. Further it is not the intent of the present invention to teach tool construction methods which is known by those skilled in the art, however several examples of tool construction methods are provided to describe the use of the present invention. It should be understood that the method described of venting a forming surface is suitable for any application where gas or liquid must be supplied or removed from the forming surface.

The present invention described herein would be effective and economical in molding applications, wherein a venting surface is required to produce a part. The process described is superior to the other methods of venting a mold. The method described herein is inexpensive and requires minimal time. The present invention is unique compared to other methods in that this method is not limited by the size, material or surface texture. Furthermore, the spray metal mold requires only a few days to manufacture. The spray metal layer can be tailored to the tool applications environment, such as wear resistance or corrosion resistance by selecting a wide range of metals.

BRIEF DESCRIPTION OF THE DRAWINGS

The invention will be described in relation to the following illustrations. In FIGS. 1 through 11, the key is as follows:

(1) model
(2) pin
(3) spray metal layer
(4) thermal spray device
(5) hole in spray metal layer
(6) textured surface
(7) porous backfill
(8) mold support structure
(9) vent port
(10) reinforcement layer
(11) spray metal layer with interconnected porosity
(12) hole in model
(13) vent hole in model
(14) parting agent layer
(15) hollow insert FIG. 1 depicts a cross-sectional isometric view of a model (1) with textured surface (6), inserted with pins (2) and parting agent layer (14).

FIG. 2 depicts a cross-sectional view of a model (1) with pins (2), textured surface (6), parting agent layer (14) and spray metal layer (3) during the thermal spray process with thermal spray device (4).

FIG. 3 depicts a cross-sectional view of a model (1) with textured surface (6), parting agent layer (14) after deposition of spray metal layer (3) and holes (5) produced after removing pins.

FIG. 4 depicts a cross-sectional view of a spray metal layer (3) with holes (5) and textured surface (6) shown as a self supporting shell.

FIGS. 7 through 11 shows various spray metal layer venting methods and combinations of said methods.

FIG. 7 depicts a cross-sectional view of a model (1), parting agent (14), with porous spray metal layer (11) comprised of interconnected porosity.

FIG. 8 depicts a cross-sectional view of a model (1), parting agent (14) with a combination of pins (2) and porous spray metal layer (11) with interconnected porosity.

FIG. 9 depicts a cross-sectional view of a model (1), parting agent (14) with holes in model (12) as a means for producing holes in spray metal layer (3).

FIG. 10 depicts a cross-sectional view of a model (1), parting agent (14) with holes in model (13) connected to a gas supply as a means for producing holes in spray metal layer (3) during the spray process.

FIG. 11 depicts a cross-sectional view of a model (1), parting agent (14) and spray metal layer (3) with encapsulated hollow inserts (15).

DETAILED DESCRIPTION OF THE INVENTION

In the preferred embodiment, the process of producing a mold surface comprised of a layer of thermal spray metal providing venting channels through the thermal spray metal layer is described in FIG. 1 through FIG. 3 and FIG. 7 through FIG. 11. Further uses of the present invention and mold construction methods by way of example will be described in FIG. 4 through FIG. 6B.

Figure 1:
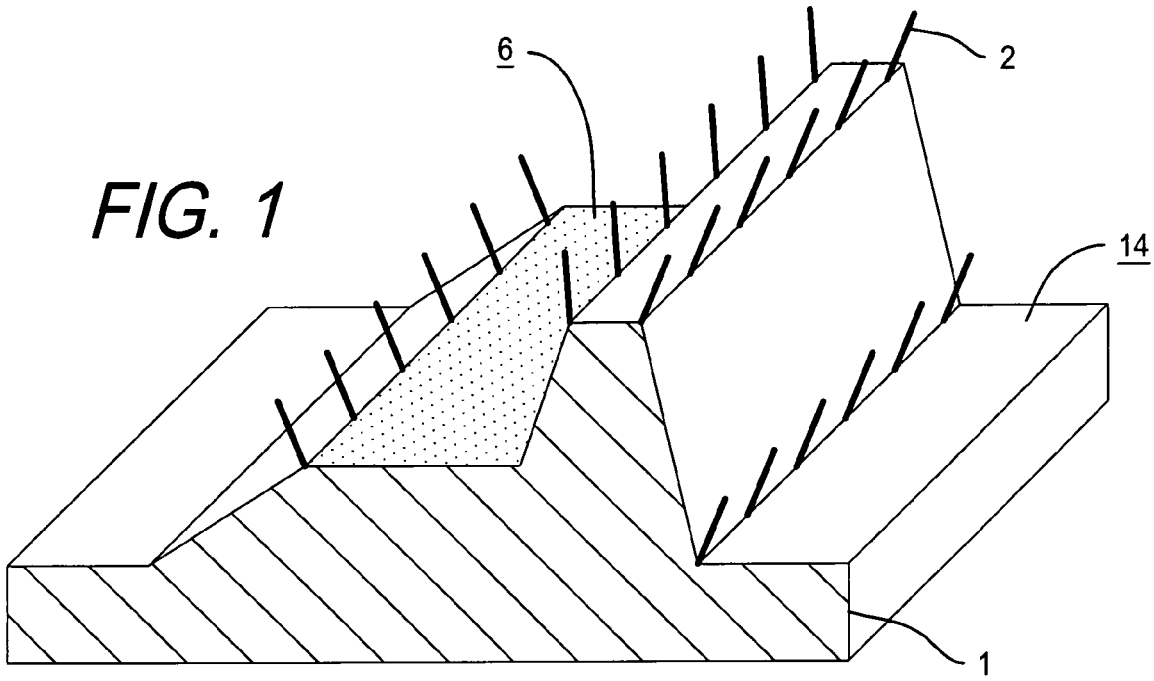
Figure 2:
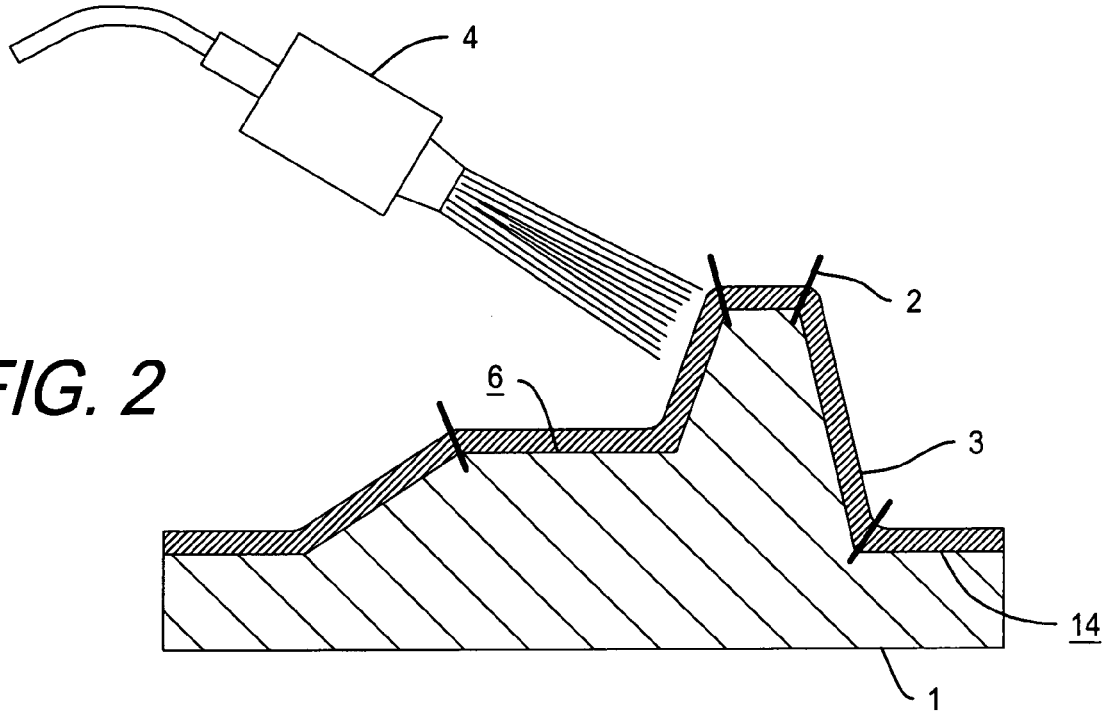

Referring to FIG. 1, there is shown a pattern, target or mandrel, commonly referred to as a mold model (1), which is the inverse of the shape of the desired mold surface. The model is produced from a modeling board available from Huntsman of Salt Lake City, Utah and others. The surface is further grained in the required areas with the desired texture (6). A plurality of metal tapered pins with an outside diameter of 0.018 inch are inserted in the model surface about 0.13 inch deep or as deep as necessary to rigidly locate the pin in the model material. The pin is inserted at such an angle as to prevent shadowing or uneven spray metal buildup around the pin. The pins and model are further sprayed with a thin layer of polyvinyl alcohol (PVA) parting agent less than 0.005 inch thick. In FIG. 2, the model (1) with surface texture (6) is prepared with pins (2), coated with polyvinyl alcohol and thermal sprayed with a layer of zinc alloy from 0.080 to 0.125 inch thick. The spray metal is deposited using a two wire arc thermal spray system moving perpendicular to the model surface and at a standoff of 8 inches. The model is rotated as necessary to deposit a uniform metal layer. The metal spray is a dense layer with less than 5% porosity. The temperature of the model is maintained less than 150° F. with carbon dioxide cooling gas throughout the entire metal spray process. Particularly, the spray parameters for 1.6 mm diameter zinc alloy wire are:

| | |
|---|---|
| Amperage | 100 amps |
| Voltage | 25 volts |
| Spray Pressure: | 40 psi |

After the spray metal layer deposit reaches the desired thickness, mold construction begins and the embodiments of the present invention diverge. Several mold construction methods exist for a spray metal layer on a model in order to fabricate a mold with venting channels.

Figure 3:
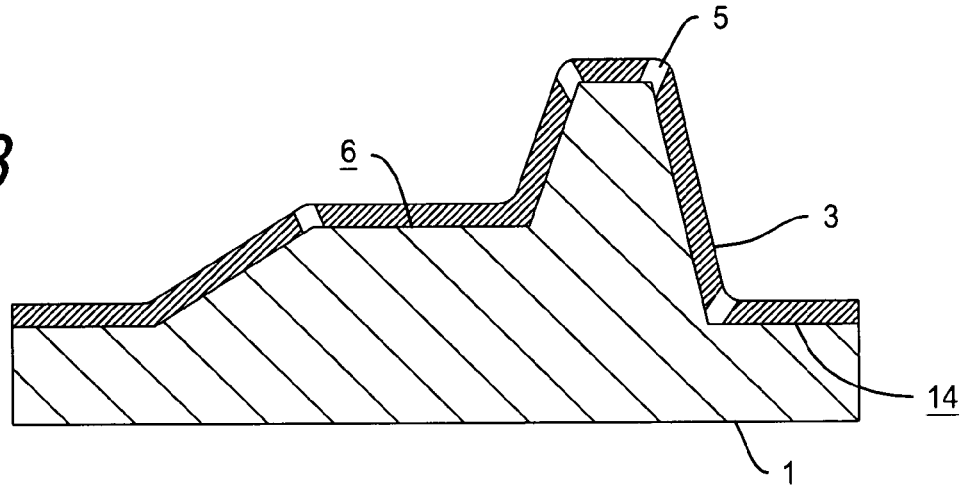
Figure 4:
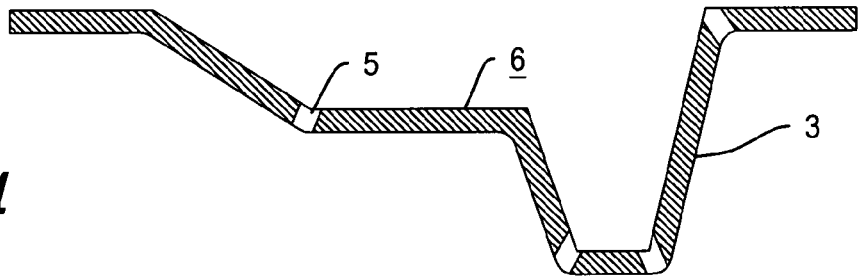

In the preferred embodiment the pins are removed producing venting holes in the spray metal layer as shown in FIG. 3 and further separated from the model producing a self supporting spray metal layer (3), commonly referred to as a shell illustrated in FIG. 4, with venting holes (5) in the textured surface (6).

Figure 5A:
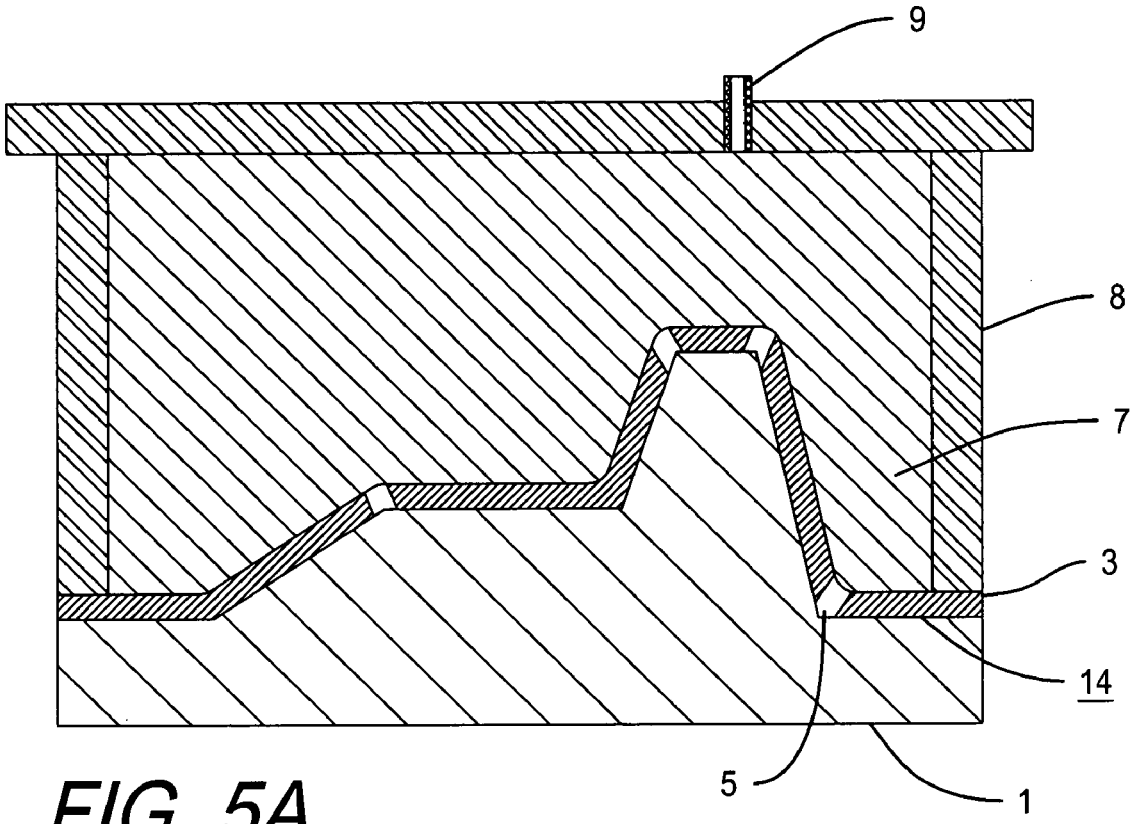
FIG. 5A depicts a cross-sectional view of a vacuum mold construction method with model (1), parting agent layer (14), spray metal layer (3) with holes (5) and a back structure (8) filled with porous backfill material (7) and vent port (9).
Figure 5B:
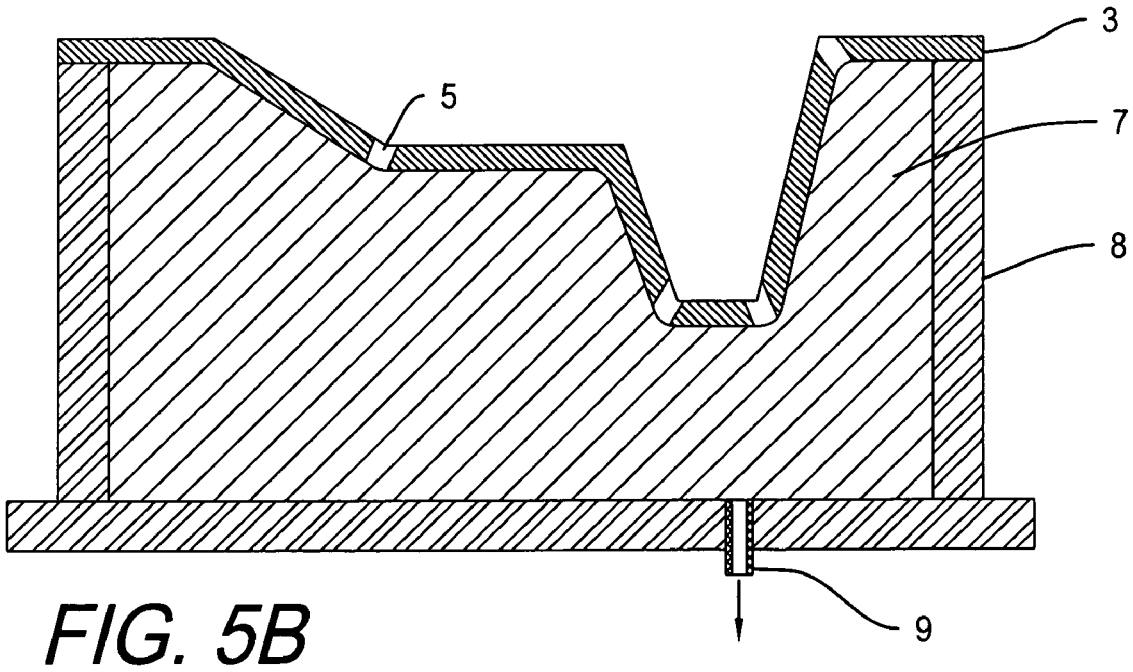
FIG. 5B depicts a cross-sectional view of a vacuum mold after separating the mold from the model with spray metal layer (3) with holes (5) and a back structure (8) filled with porous backfill material (7) and vent port (9).

In another embodiment the model and spray metal layer in FIG. 3 is further supported with a porous backfill media (7), and confined in a sealed enclosure (8) with a venting port as in FIG. 5A to construct a mold. When the model is separated, FIG. 5B, a mold results with a spray metal layer (3) with venting holes (5), a porous backfill structure (7) enclosed and sealed by mold support structure (8) producing a mold surface for exhausting or supply gas to the molding surface.

Figure 6A:
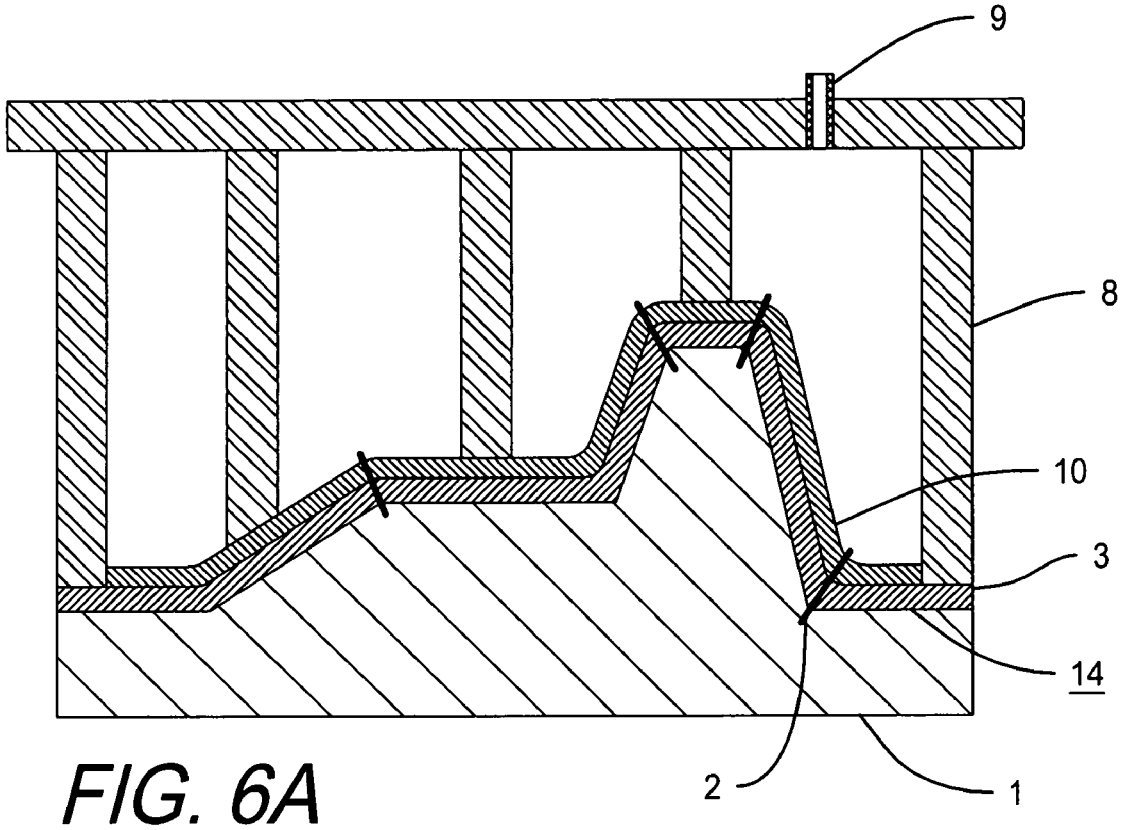
FIG. 6A depicts a cross-sectional view of another vacuum mold construction method with model (1), parting agent layer (14), spray metal layer (3) with pins (2), reinforced with layer (10) and a back support structure (8) and vent port (9).
Figure 6B:
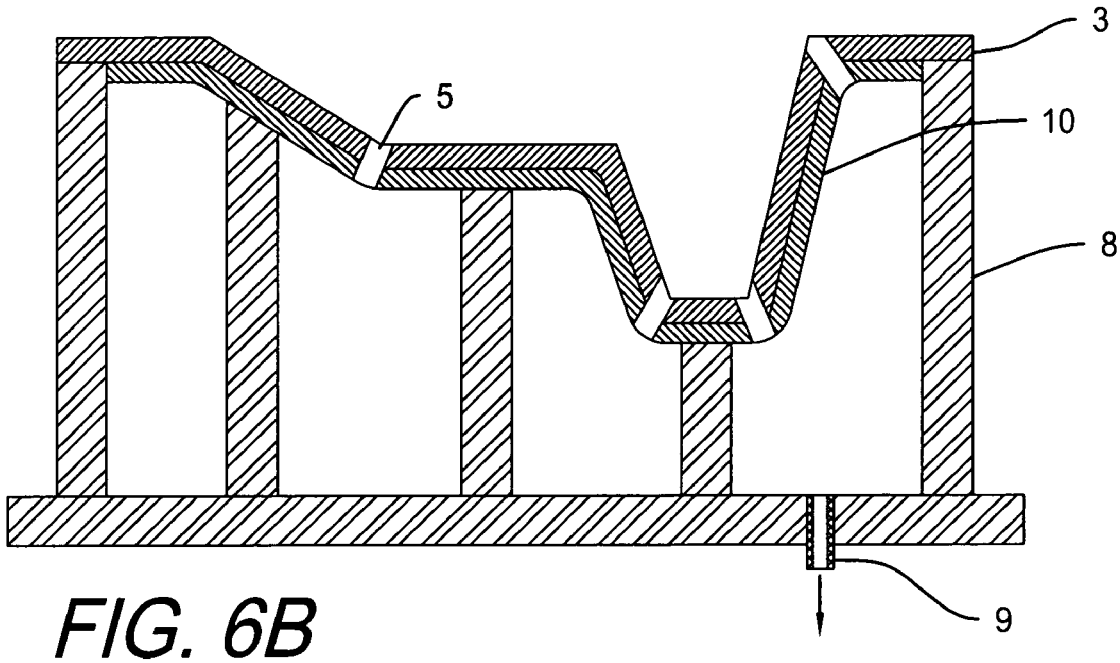
FIG. 6B depicts a cross-sectional view of a vacuum mold after separating the mold from the model with spray metal layer (3) and reinforcement layer (10) after removing pins and exposing holes (5) with a back support structure (8) and vent port (9).

In another embodiment the model and spray metal layer in FIG. 2 is further laminated with an epoxy based reinforcement layer (10) and supported with a space frame mold support structure (8), commonly referred to as an egg crate structure, and confined in a sealed enclosure (8) with a venting port as in FIG. 6A to construct a mold. Before the back plate of the egg crate structure is attached, the pins (2) are removed and the back plate is attached. The model is removed producing a mold with a spray metal surface (3) with a reinforcement layer (10) comprised of vent holes (5) and an egg crate mold support structure (8) as in FIG. 6B.

Figure 7:
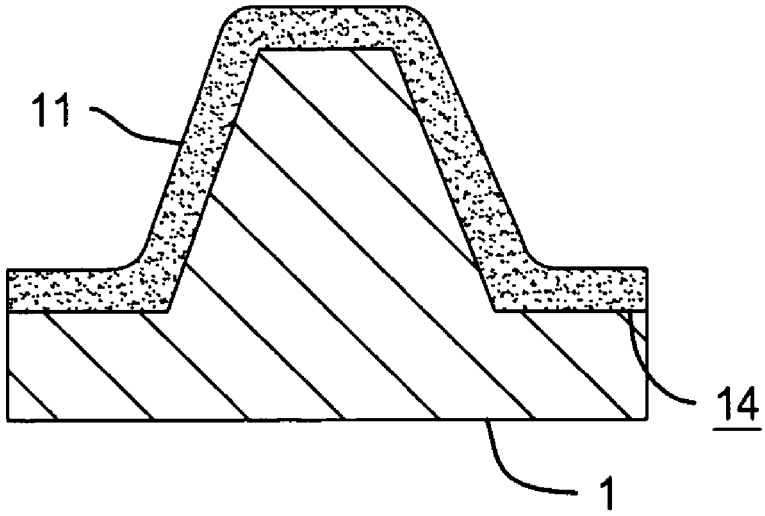
Figure 8:
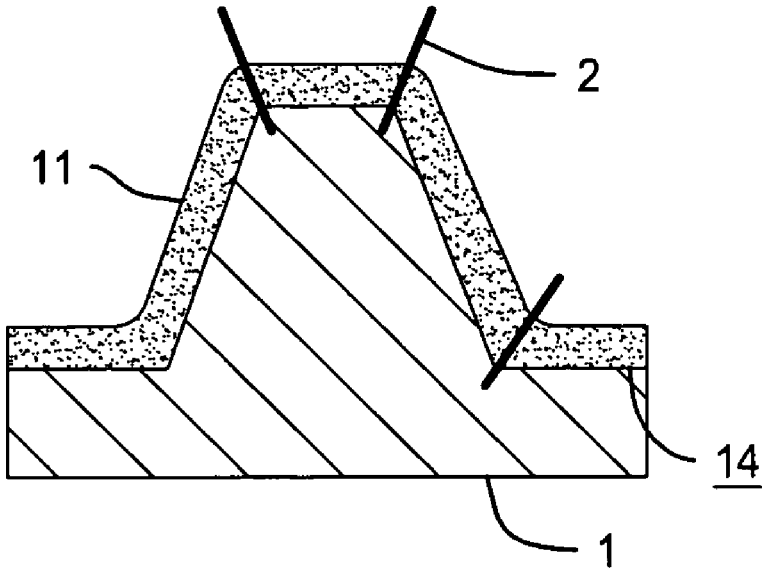
Figure 9:
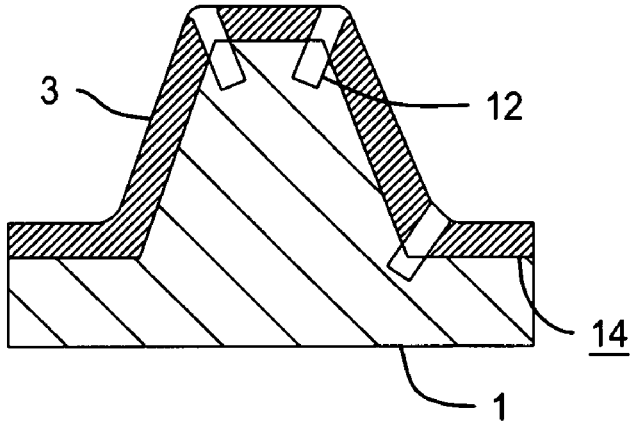
Figure 10:
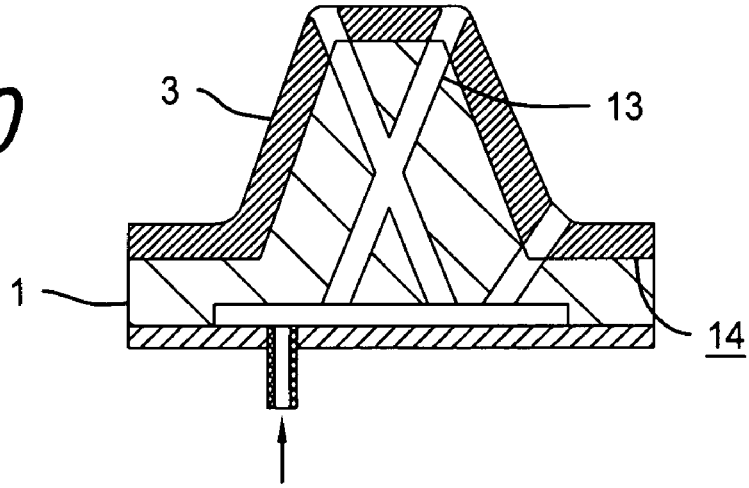
Figure 11:
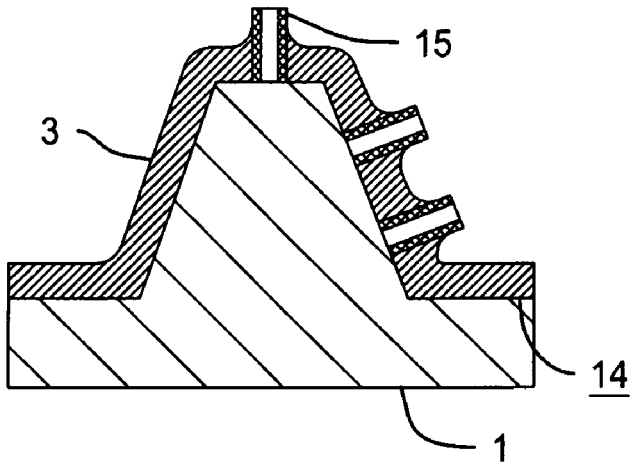

In another embodiment, a venting mold surface is produced by spraying a metal layer with interconnected porosity (11) on a model (1) as in FIG. 7. A porous spray metal layer can be produced with up to 35% porosity. The porosity is a function of mold geometry. Typically porosity will be higher in corners and deep pockets. One method of producing a spray metal layer with a porous surface is to use a two wire arc spray system. Porosity is produced using a two wire arc system at low spray pressure and a small impingement angle with respect to the model surface. On the model described herein in the preferred embodiment, a porous zinc metal layer can be deposited with arc spray parameters of 80 amps, 25 volts, and 25 psi spray pressure at an 8" standoff and a 25 to 35 degree impingement angle with respect to the model surface. The porous spray metal layer described can also be utilized in conjunction with pins and hollow inserts as described hereinafter.

In another embodiment, vents are produced in mold surface by holes placed in the model. A plurality of small holes of 0.025 inch diameter are drilled at least 0.060 deep in the models surface. The model surface is prepared with the necessary parting agent if required, and sprayed with a porous or dense spray metal layer. The small holes in the model will produce back pressure from the spray pressure, preventing metal from being deposited in the local area of the hole, thereby leaving a hole or small area in the spray metal layer. Another technique shown in FIG. 10 utilizes a similar technique of drilling holes in the model, but in this case the holes in the model are connected to a source of pressurized gas. This will create the same effect by producing back pressure in the spray in localized areas, thereby generating holes in the spray metal layer.

In another embodiment, vents are produced in mold surface by holes produced by hollow metal inserts attached to the model and permanently sprayed into the spray metal layer. Inserts are encapsulated in the spray metal layer by applying a layer of parting agent to the model and further attaching the insert to the model surface with the parting agent. After applying the spray metal layer (3) to the model (1) and the parting agent (14) the hollow insert (15) is permanently fixed in the spray metal layer as in FIG. 11.

It should be understood that those skilled in the art of spraying metal use robots, indexing tables, various cooling gases, various model materials, and various parting agents, to fabricate a spray metal mold. It is not the intent of this invention to explain the spray metal process or tool construction process, but rather to demonstrate novel methods for producing venting channels in a spray metal article. This variation and others will be appreciated by those skilled in the art, and within the intended scope of this invention as claimed below. As previously stated, a detailed embodiment of the present invention is disclosed herein; however, it is to be understood that the disclosed embodiment is merely exemplary of the invention that may be embodied in various forms. Therefore, within the scope of the appended claims, the present invention may be practiced other than as specifically described.

What is claimed:

1. A method of manufacturing a vacuum forming mold having a hole to evacuate gas during a vacuum forming process to deform a plastic material comprising the steps of:

(a) providing a model including a surface having a characteristic and a pin extending from the surface;

(b) spraying a layer of a material onto the surface of the model to create a shell including a surface having the characteristic of the surface of the model, the pin extending completely through the layer of material to the surface of the shell; and (c) removing the pin from the shell so as to provide a hole extending completely through the shell to the surface of the shell and removing the shell from the model to provide a vacuum forming mold having a hole to evacuate gas during a vacuum forming process to deform a plastic material.

2. The method defined in claim 1 wherein said step (a) is performed by initially providing a model including a surface having a characteristic and subsequently inserting the pin into the surface.

3. The method defined in claim 1 wherein said step (a) is performed by providing a model including a surface having a characteristic and a plurality of pins extending from the surface, and wherein said step (c) is performed by removing the plurality of pins from the shell so as to provide a hole through the shell and removing the shell from the model to provide a vacuum forming mold having a plurality of holes to evacuate gas.

4. The method defined in claim 1 wherein said step (b) is performed by spraying a layer of a metallic material onto the surface of the model to create the shell.

5. The method defined in claim 4 wherein said step (b) is performed by a thermal spray process.

6. The method defined in claim 1 wherein said step (b) is performed by providing the layer of the material with a porosity of less than 5%.

7. The method defined in claim 1 wherein said step (b) is performed by initially applying a parting agent to the surface of the model and subsequently spraying the layer of the material onto the surface of the model.

8. The method defined in claim 1 wherein said step (b) includes the further step of laminating the sprayed layer of material with an epoxy based reinforcement layer.

9. The method defined in claim 1 wherein said step (c) is performed by initially removing the pin from the sh&ll and subsequently removing the shell from the model.

10. The method defined in claim 1 wherein said step (c) is performed by initially removing the shell from the model and subsequently removing the pin from the shell.

11. A method of peiforming a vacuum forming process to cause a plastic material to confonn to a surface of a vacuum forming mold comprising the steps of:

(a) providing a vacuum forming mold by (1) providing a model including a surface having a characteristic and a pin extending from the surface, (2) spraying a layer of a material onto the surface of the model to create a shell including a surface having the characteristic of the surface of the model, the pin extending completely through the layer of material to the surface of the shell, and (3) removing the pin from the shell so as to provide a hole extending completely through the shell to the surface of the shell and removing the shell from the model to provide a vacuum forming mold including a surface having a hole to evacuate gas;

(b) providing a plastic material adjacent the surface of the vacuum forming mold; and (c) creating a vacuum in the hole formed through the vacuum forming mold to cause the plastic material to conform to the surface of the vacuum forming mold.

12. The method defined in claim 11 wherein said step (a)(1) is performed by initially providing a model including a surface having a characteristic and subsequently inserting the pin into the surface.

13. The method defined in claim 11 wherein said step (a)(1) is performed by providing a model including a surface having a characteristic and a plurality of pins extending from the surface, and wherein said step (c) is performed by removing the plurality of pins from the shell so as to provide a hole through the shell and removing the shell from the model to provide a vacuum forming mold having a plurality of holes to evacuate gas.

14. The method defined in claim 11 wherein said step (a)(2) is performed by spraying a layer of a metallic material onto the surface of the model to create the shell.

15. The method defined in claim 14 wherein said step (a)(2) is performed by a thermal spray process.

16. The method defined in claim 11 wherein said step (a)(2) is performed by providing the layer of the material with a porosity of less than 5%.

17. The method defined in claim 11 wherein said step (a)(2) is performed by initially applying a parting agent to the surface of the model and subsequently spraying the layer of the material onto the surface of the model.

18. The method defined in claim 11 wherein said step (a)(2) includes the further step of laminating the sprayed layer of material with an epoxy based reinforcement layer.

19. The method defined in claim 11 wherein said step (a)(3) is performed by initially removing the pin from the shell and subsequently removing the shell from the model.

20. The method defined in claim 11 wherein said step (b) is performed by a vacuum molding process.

* * * * *